US009580224B2

(12) United States Patent
Ziegenfelder et al.

(10) Patent No.: US 9,580,224 B2
(45) Date of Patent: Feb. 28, 2017

(54) COMPOSITE CONTAINER WITH INTERNAL FITMENT

(71) Applicant: Sonoco Development, Inc., Hartsville, SC (US)

(72) Inventors: Kurt A. Ziegenfelder, Florence, SC (US); Robert T. Versluys, Florence, SC (US)

(73) Assignee: Sonoco Development, Inc., Hartsville, SC (US)

( * ) Notice: Subject to any disclaimer, the term of this patent is extended or adjusted under 35 U.S.C. 154(b) by 151 days.

(21) Appl. No.: 14/168,534

(22) Filed: Jan. 30, 2014

(65) Prior Publication Data

US 2015/0210458 A1 Jul. 30, 2015

(51) Int. Cl.
*B65D 81/20* (2006.01)
*B65D 1/12* (2006.01)
(Continued)

(52) U.S. Cl.
CPC ..... *B65D 81/20* (2013.01); *B05B 11/0037* (2013.01); *B65B 7/2842* (2013.01); *B65D 1/12* (2013.01); *B65D 25/40* (2013.01); *B65D 33/14* (2013.01); *B65D 41/005* (2013.01); *B65D 83/0055* (2013.01); *B65D 2251/0015* (2013.01);
(Continued)

(58) Field of Classification Search
CPC ..... B65D 81/20; B65D 1/12; B65D 33/14; B65D 25/40; B65D 41/005
See application file for complete search history.

(56) References Cited

U.S. PATENT DOCUMENTS 3,539,083 A 11/1970 Prussin
4,121,737 A * 10/1978 Kain ..... B65D 83/0061 222/212
(Continued)

FOREIGN PATENT DOCUMENTS

DE 92 11 396 12/1992
EP 1 985 555 A1 10/2008

OTHER PUBLICATIONS

Invitation to Pay Additional Fees and Partial International Search Report in International Application No. PCT/US2015/013272.
(Continued)

*Primary Examiner* — Anthony Stashick
*Assistant Examiner* — James Way
(74) *Attorney, Agent, or Firm* — Miller, Matthias & Hull LLP

(57) ABSTRACT

A composite container for storing product in a hermetically-sealed volume includes a fitment that forms one end of the container. The fitment has an outer face, an inner face, a perimeter edge with an attachment surface formed therein, and an aperture between the outer face and the inner face with an aperture mount configured to receive and secure a closure for sealing the aperture of the container. The fitment also includes a sealing surface on the inner face that surrounds the aperture, and a products pouch with a pouch opening that is sealed to the sealing surface. The fitment further includes a can having a first end that is coupled to the attachment surface of the fitment and a substantially-rigid tubular body extending away from the fitment to form an interior volume that surrounds the products pouch.

20 Claims, 10 Drawing Sheets

(51) Int. Cl.

| | |
|---|---|
| ***B65D 33/14*** | (2006.01) |
| ***B65D 25/40*** | (2006.01) |
| ***B65D 41/00*** | (2006.01) |
| ***B65B 7/28*** | (2006.01) |
| ***B65D 83/00*** | (2006.01) |
| ***B05B 11/00*** | (2006.01) |

(52) U.S. Cl.
CPC ..... *B65D 2251/0087* (2013.01); *B65D 2251/0093* (2013.01); *B65D 2525/282* (2013.01)

(56) References Cited

U.S. PATENT DOCUMENTS 4,854,483 A * 8/1989 Haggart ..... B65D 83/0061 222/105
5,263,519 A 11/1993 Reyner
5,474,203 A * 12/1995 Baker ..... B65D 5/14 222/105
5,582,254 A * 12/1996 Pistek ..... A62C 3/07 169/36
5,803,346 A * 9/1998 Baker ..... B65D 77/065 229/117.3
6,126,315 A * 10/2000 Ichikawa ..... B65D 31/10 383/104
6,519,436 B2 * 2/2003 Katsuyama ..... B65D 77/06 229/117.27
6,827,237 B2 12/2004 Yorn
7,209,689 B2 * 4/2007 Matsumoto ..... G03G 15/0898 222/DIG. 1
7,571,835 B2 8/2009 Hill et al.
8,172,110 B2 * 5/2012 Beine ..... A61J 1/05 222/105
8,474,655 B2 7/2013 Hackleman et al.
8,505,774 B2 8/2013 Nimmo et al.
2006/0243783 A1 * 11/2006 Spivey ..... B65D 5/4208 229/117.3
2009/0212071 A1 * 8/2009 Tom ..... B65B 31/003 222/95
2011/0056983 A1 * 3/2011 Hackleman ..... B43L 25/00 222/105
2013/0345647 A1 * 12/2013 Har-Shai ..... A62C 13/00 604/257

OTHER PUBLICATIONS

Aurena Laboratories. "Bag on Valve." vvww.bagonvalve.com Aug. 26, 2013.
Bag-In-Can-CCL Container. "ABS Bag-in-Can System." www.clcontainer.com/products/bag-in-ca . . . Aug. 26, 2013.
Aerotech Labs. "Bag-in-a-Can, Bag-On-Valve (BOV) Aerosol Filling." www.customfiller.com/bag-in-a-can.html. Aug. 26, 2013.
Bag-on-Valve Aerosols. "Distributor Login." www.wearvalleyaerosols.co/uk/bagonvalv. Aug. 26, 2013.

* cited by examiner

COMPOSITE CONTAINER WITH INTERNAL FITMENT

TECHNICAL FIELD

This patent application relates generally to containers for storing perishable products, household cleaners, and industrial chemicals, and more specifically to containers for storing products within a hermetically-sealed volume.

BACKGROUND

Many types of containers have been developed for storing consumer products, perishable foodstuffs, and other manufactured goods in hermetically-sealed volumes that prevent the exchange of air between the inside of the container and ambience. The designs for these containers can vary greatly depending on the nature of the product that is stored, such as its state (solid or liquid), chemical composition, whether or not it is stored under pressure, and the like. In many cases, the walls of the container are configured to provide structural support that defines the shape of the container, puncture protection that maintains its integrity, as well as a barrier that prevents the stored product from escaping and outside air from entering into the sealed volume. Consequently, the inside surface of the container walls are typically wetted by contact with the stored product, which may in turn soil the container walls or otherwise render the entire container unsuitable for recycling.

In addition, the requirement to design the walls of the container for both the structural support/puncture protection functions and the barrier or product containment function may raise the cost of manufacturing the container. For example, a large amount of dual-purpose material may be required to form container walls made from a single material that is both rigid and impervious to the stored product. The expense of coating the internal surfaces of a pervious structural/puncture resistant material with an impervious coating or liner may also increase the number of manufacturing steps. Moreover, in cases where the bottoms and tops of the containers are not integrally formed with the sidewalls, and that may even be made from different materials, the expense of providing a fluid-tight joint at the interface between the different components can further raise the manufacturing costs.

A need therefore exists for a container that is both less expensive to manufacture and that provides enhanced separability of its various components for the segregation of recyclable waste after use It is to the provision of such a container that addresses these and other needs that the present disclosure is primarily directed.

SUMMARY

Briefly described, a composite container feat storing product in a sealed volume that includes a fitment forming an end of the container. The fitment has an outer face, an inner face, and a perimeter edge with an attachment surface formed therein. The fitment also includes an aperture extending between the outer face and the inner face, as well as an aperture mount that is configured to receive and secure a closure for sealing the aperture. The fitment further includes a sealing surface formed into the inner face and surrounding the aperture. The composite container also includes a products pouch with a pouch opening that is sealed to the sealing surface of the fitment. The composite container further includes a can having a first end that is coupled to the attachment surface of the fitment and a substantially-rigid can body extending away from the fitment to form an interior volume that surrounds the products pouch. Each of the fitment, the products pouch and the can are generally adapted for enhanced separability from each other after use for segregation into recyclable and non-recyclable waste. For instance, in one aspect the fitment and the can may segregated into recyclable plastic and paperboard waste streams, respectively, while the products pouch is disposed of as non-recyclable waste.

Another embodiment of the composite container includes a fitment forming the top of the container and having an outer face, an inner face, and a perimeter edge spaced from a center axis with an attachment surface formed therein. The fitment also includes an aperture extending between the outer face and the inner face, and an aperture mount that is configured to receive and secure a closure for sealing the aperture of the container. The fitment further includes a sealing surface formed into the inner face and surrounding the aperture and substantially parallel with the center axis. The composite container also includes a products pouch with a pouch opening sealed to the sealing surface. The composite container further includes a can having a first end that outwardly surrounds and is coupled to the attachment surface of the fitment, a substantially-rigid body extending away from the fitment to form an interior volume that surrounds the products pouch, and a base coupled to a second end of the can opposite the first end to enclose the interior volume and support the spray container in an upright position.

Another embodiment of the present disclosure includes a method of making a composite container with enhanced separability for the segregation of recyclable waste after use. The method includes obtaining a fitment that forms the top of the container, with the fitment having an outer face, an inner face, a perimeter edge having an attachment surface formed therein, an aperture extending between the outer face and the inner face and having an aperture mount adapted to receive and secure a closure for sealing the aperture, and a sealing surface formed into the inner face and surrounding the aperture and substantially parallel with the center axis. The method also includes obtaining a products pouch with a pouch opening, and sealing the pouch opening to the sealing surface. The method further includes obtaining a can comprising a substantially rigid tubular body having a first end and a second end opposite the first end, and coupling the can to the perimeter edge of the fitment with the first end outwardly surrounding the attachment surface and the body extending away from the fitment to form an interior volume that surrounds the products pouch.

These and other aspects, features, and advantages of the composite container of this disclosure will become apparent to the skilled artisan upon review of the detailed description set forth below taken in conjunction with the accompanying drawing figures, which are briefly described as follows.

DETAILED DESCRIPTION

Illustrated in FIGS. 1-22 are several representative embodiments of a low-cost, sealable composite container for liquid products or solid products. The composite container of the present disclosure comprises a simplified construction that allows for enhanced separability and segregation of the container components into recyclable waste after use. The disclosure also includes one or more methods for making the composite container. As described in more detail below, the composite container can provide several significant advantages and benefits over other types of containers, as well as methods for making container. It is noted, however, that the recited advantages are not meant to be limiting in any way, as one skilled in the art will appreciate that other advantages may also be realized upon practicing the present disclosure.

Figure 1:
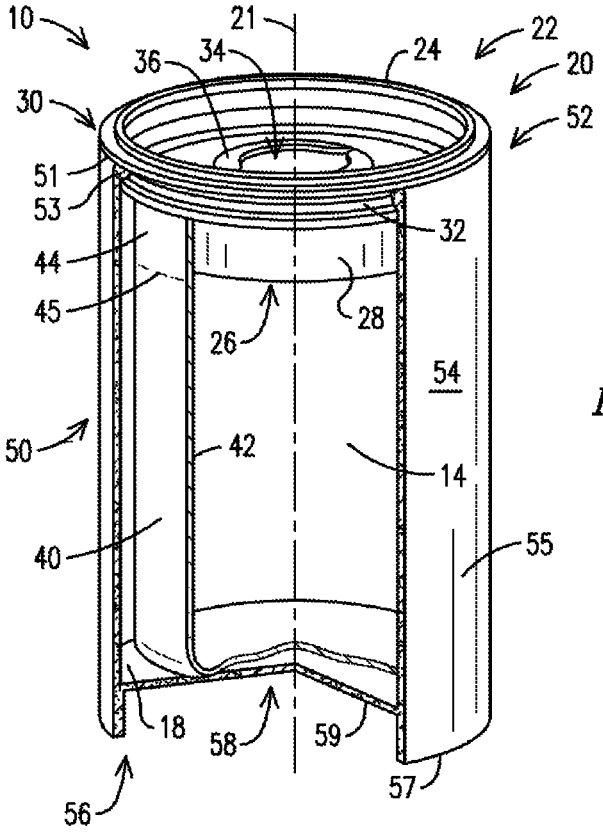
FIG. 1 is a cut-away perspective view of a composite container with an internal fitment, in accordance with one representative embodiment of the present disclosure.

Referring now in more detail to the drawing figures, herein like parts are identified with like reference numerals throughout the several views, FIG. 1 is an upright composite container 10 for storing and dispensing a product, in either liquid or solid form, and generally includes a fitment 20 that forms the upper end of the container. The fitment 20 has an outer face 22, an inner face 26, and a rim or perimeter edge 30 spaced from a longitudinal or center axis 21 extending through the composite container and fitment, and with the perimeter edge 30 having an attachment surface 32 formed therein. In one aspect, the perimeter edge 30 can also include a ridge 24 extending in the axial direction that allows the fitment 20 to interlock with the bottom of a similar container when stacked. The fitment also has an aperture 34 that extends between the outer face 22 and the inner face 26 and that is surrounded by an aperture mount 36 that in one aspect can be a threaded neck finish, as shown in the illustrated embodiment. The aperture mount 36 can be configured to receive and secure a removable closure (not shown in FIG. 1) for sealing the aperture 34 of the composite container 10.

The fitment 20 further includes a sealing surface 28 formed into the inner face 26 and surrounding the aperture 34. In one aspect, the sealing surface 28 can be formed into the perimeter portion of the inner face 26 and can be substantially parallel with the center axis 21. The fitment 20 can generally have a unibody construction made from a recycled or recyclable plastic or similar material that can be molded, pressed or shaped into the desired shape having the above-described structures and surface features.

The composite container 10 also includes a products pouch 40 with an opening in the upper portion 44 that can be sealed around the sealing surface 28 on the inner face 26 of the fitment 20 with a hermetic seal to form an airtight inner volume 14 defined by the interior surface of the pouch 40, the inner face 26 of the fitment 20, and the bottom surface of a closure (not shown). When the sealing surface 28 of the fitment 20 is substantially parallel with the center axis 21 the seal between the fitment 20 and the products pouch 40 can also be aligned with the longitudinal axis 21 of the composite container 10. As described below, the inner volume 14 is accessible through the aperture 34 upon removal or operation of the closure. The products pouch 40 generally comprises one or more layers of material 42 that can be configured to contain the intended product, in either a liquid or solid state, for extended periods of time.

The container 10 further includes a substantially-rigid outer shell or can 50 having an upper first end 52 and a lower second end 56. The upper end 52 is coupled or locked to the attachment surface 32 formed into the perimeter edge 30 of the fitment 20, with the substantially-rigid can body 54 extending away from the fitment 20 to form a generally annular volume 18 that surrounds the products pouch 40. In one aspect, the can 50 can be made from low-cost, spiral-wound, and recycled or recyclable paperboard material 55 having a cut edge 51 at the upper end 52 and a cut edge 57 at the lower end 56.

Although not required, the can 50 can also include a base 58 that covers the opening at the second end 56 of the can and encloses the annular volume 18 between the pouch 40 and the inside surface of the can body 54. The base 58 can protect the lower portions of the pouch and also provide support for the container 10, especially when it is standing in an upright orientation. In one aspect, the base 58 can be a plug base 59 that is inserted into the opening at the second end 56 and secured to the can body 54. The plug base 59 can have straight circumferential surface that may be secured to the inner surface of the can with an adhesive. In other aspects the plug base can include a rabbet joint formed by a projecting ridge (not shown) that extends radially from the rim of the base to abut and cover the cut edge at the second end of the can body, and that can be secured to the inner surface of the can with an adhesive and/or frictional fit.

Similar to the can 50 to which it attaches, the base 58 can be made from a low-cost, recycled or recyclable paperboard material. In other embodiments, however, the base can be made from a metallic material, such as tin or aluminum, that provides enhanced support for the can 50, particularly in larger sizes of the container 10 or in containers that are configured to store heavier amounts of product.

Because the product stored within the composite container 10 is entirely enclosed within the inner volume 14 defined in part by the interior surface of the pouch 40, the stored product does not come into contact with the inside surfaces of the can 50 or the base 58. Thus, the can 50 (including the base 58) may not require any coatings, films, treatments or manufacturing steps that may otherwise be needed to form an airtight or liquid-tight barrier that prevents the stored product from escaping the composite container 10 and outside air from entering into the sealed inner volume 14. Consequently, the design criteria of the can component 50 of the composite container 10 may be reduced or simplified to providing the structural support for the fitment component 20 and the puncture protection for the pouch component 40 that is sealed to and suspended from the inner face 26 of fitment 20.

The composite container 10 can be configured for easy disassembly and segregation of the individual components for recycling and/or disposal after use. For instance, the fitment component 20 and the can component 50 can be adapted for manual separation with a strong tug by an end user, with the can component 50 being combinable with other paper and paperboard products for recycling in a paper-based recyclable waste stream.

The now-accessible products pouch component 40 can then be removed from around the sealing surface of the fitment component 20. For instance, in one aspect a score line 45 can be formed into the products pouch 40 proximate the sealing surface 28 so that the products pouch 40 can be more easily torn from the fitment 20 during disassembly or separation. If soiled by product residue or otherwise deemed unsuitable for recycling, the products pouch 40 can be disposed of as non-recyclable waste, while the fitment 20 is combined with other plastic products for recycling in a plastics-based recyclable waste stream. Consequently, because the soiled products pouch is generally very thin and lightweight, the overall amount of non-recyclable material sent to a landfill or other disposal facility can be greatly reduced.

If instead the products pouch 40 is found suitable for recycling, the products pouch 40 may be combined with other metal foils or similar materials for recycling in a metals-based recyclable waste stream.

The capability for easily separating, segregating and recycling at least the larger components of the composite container can provide significant advantages for the environment through the reduction in the amount of waste that is eventually sent to landfills. For example, in many cases only the products pouch will require disposal, with the fitment, can and closure components being recyclable into other products or even being recycled or re-used again as part of another composite container. The capability for separating, segregating and recycling the larger components of the composite container may also lower costs for the eventual user, especially industrial users, by improving the ability of the organization to separate used composite containers into more manageable recyclable and non-recyclable waste product streams.

Figure 2A:
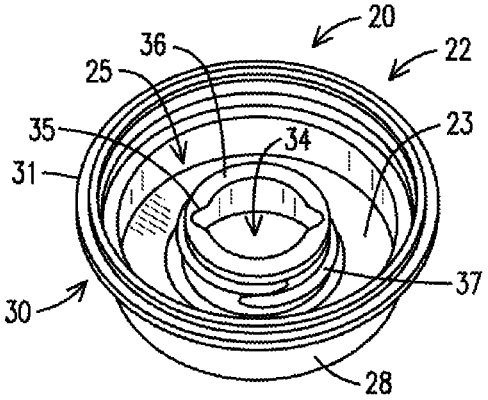
FIGS. 2A and 2B are perspective and cross-sectional side views, respectively, of the internal fitment of the composite container of FIG. 1.
Figure 2B:
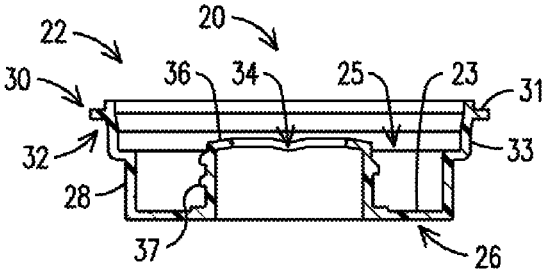

FIGS. 2A and 2B are perspective and cross-sectional side views, respectively, of the fitment 20 that forms the upper end of the upright composite container 10 of FIG. 1. As viewed from the outer face 22, the annular portion 23 of the fitment 20 between the aperture mount 36 and the perimeter edge 30 can be depressed to form the floor of a ring-shaped depression 25. As viewed from the side, the outer sidewall surface of the downwardly-extending depression 25 can become the sealing surface 28 to which the products pouch can be attached, and with the underside surface of the annular portion 25 forming the top boundary of the inner volume 14 (FIG. 1).

As best viewed in FIG. 2B, the attachment surface 32 in the perimeter edge 30 can be stepped radially-outward from the sealing surface 28, so that the inner surface of the can body 54 is spaced from the products pouch 40 (FIG. 1) that hangs freely from the sealing surface 28. When the products pouch is sealed to the sealing surface 28 of the fitment 20 prior to coupling the first end of the can to the attachment surface 32, this separation can be advantageous for avoiding contact between the can and products pouch that may possibly damage the products pouch.

In the illustrated embodiment, the attachment surface 32 can include a groove 33 that is sized and shaped to receive a bead 53 (FIG. 1) formed into the first end 52 of the can 50. This can allow the fitment 20 to be press fit into the first end 51 of the can 50 (or the first end of the can press fit onto the perimeter edge 30 of the fitment 20) to secure the can 50 and the fitment 20 together. In one aspect, a boss or lip 31 can extend radially outward from the perimeter edge 30 above the attachment surface 32 and, together with the attachment surface, form a rabbet fit that receives the first end 52 of the can 50 with the cut edge 51 abutting the underside of the lip 31. This configuration can provide the composite container 10 with a smooth and clean upper edge that is both easy to handle and, as described in more detail below, can receive a removable gripper cap.

With the can 50 (and optionally the base 58) comprising a paperboard material, the materials used to make the fitment 20 and the pouch 40 can be tailored to the product that is to be stored within the composite container 10. In one aspect, for example, when the stored product is a mild petroleum-based liquid, the fitment can be made from high-density polyethylene (HDPE) while the products pouch can be a laminate material comprising a polyethylene terephthalate (PET) film adhered to a linear low-density polyethylene (LLDPE) film. In another aspect where the stored product is a mild cleaning liquid, the fitment can be made from polypropylene (PP) while the products pouch can be a polypropylene film. In yet another aspect where the stored product is a powdered beverage, the fitment can be made from HDPE while the products pouch can be a laminate material comprising a metalized polyethylene terephthalate (PET) film adhered to a HDPE film. In yet another aspect where the stored product is coffee or dry goods such as nuts and snacks, the fitment can be made from HDPE while the products pouch can be a laminate material comprising a PET film adhered to a metallic foil adhered to a LLDPE film. In yet another aspect where the stored product is an aggressive solvent, the fitment can be made from Nylon 6 while the products pouch can be a laminate comprising a PET film adhered to a metallic foil adhered to a nylon 6 extrudate. In yet another aspect, when the stored product is a pharmaceutical, the fitment can be made from a Barex® acrylonitrile-methyl acrylate copolymer while the products pouch can be a Barex® acrylonitrile-methyl acrylate copolymer film. The above material combinations for the fitment 20 and the pouch 40 are simply representative embodiments of the present disclosure, and it will be appreciated that other combinations of materials suitable for the stored products are also contemplated and considered to fall within the scope of the present disclosure.

Figure 3A:
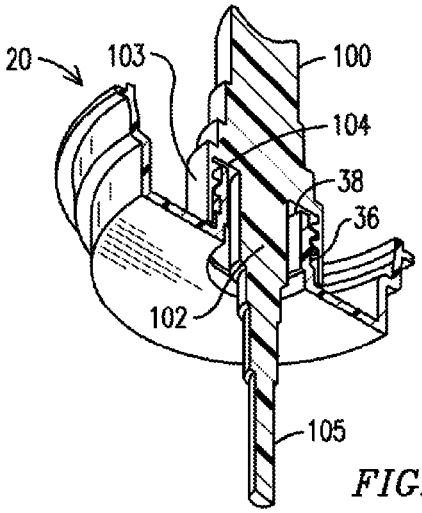
FIGS. 3A and 3B are perspective and cross-sectional side views, respectively, of the internal fitment of the composite container of FIG. 1 coupled to a pump dispenser.
Figure 3B:
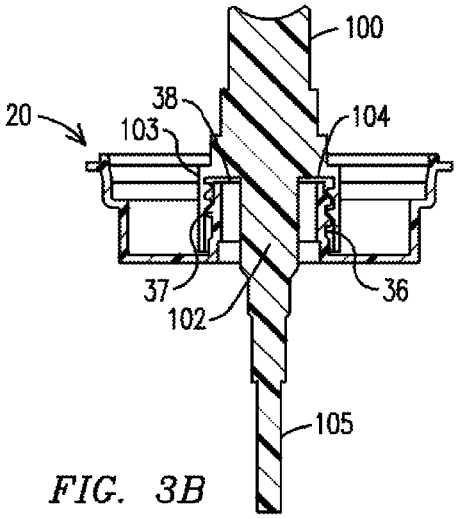

In one aspect, the aperture 34 defined by the aperture mount 36 can be provided with two opposed notches 35 (FIG. 2A) that are configured to receive vertical ridges extending from the side surfaces of a pump spray dispenser-type closure 100 having an internal suction stem 105 that extends downward into the inner volume defined by the products pouch, as shown in FIGS. 3A-3B. The interconnection between the notches and the vertical ridges can serve to hold the body 102 of the pump spray dispenser 100 in one position while a threaded collet 103 is screwed onto the threads 37 formed into the outer surface of the aperture mount 36, so as to secure the dispenser 100 into position within the aperture. In one aspect, the internal annular contact surface 104 of the pump spray dispenser 100 can be provided with a sealing surface that abuts against the top edge 38 of the aperture mount 36 to provide an airtight seal.

In another aspect, the aperture 34 can be sealed with a film or membrane (not shown) that is adhesively attached to the top edge 38 of the aperture mount 36 after the filling of the container with product to maintain an airtight inner volume during shipping and storage, and which membrane is then removed prior to installing the pump spray dispenser 100 to the fitment 20 of the composite container 10.

Figure 4A:
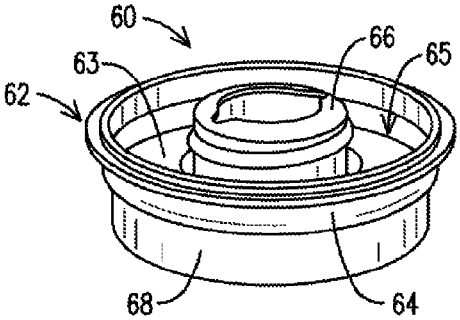
FIGS. 4A and 4B are perspective and cross-sectional side views, respectively, of the internal fitment of the composite container, in accordance with another representative embodiment.
Figure 4B:
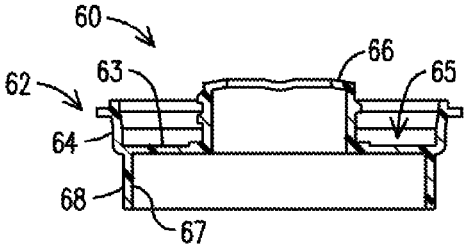

FIGS. 4A and 4B are perspective and cross-sectional side views, respectively, of another embodiment of the fitment 60 that can form the upper end of the composite container. In this configuration, the annular portion 63 of the fitment 60 between the aperture mount 66 and the perimeter edge 62 can be partially depressed below the level of the outer i to form the floor of shallow ring-shaped depression 65, and with the attachment surface 64 forming the outer sidewall of the depression 65. A skirt 67 can extend downward from the underside of the annular portion 63, with the outside surface of the skirt 67 forming the sealing surface 68 to which the products pouch can be attached.

Figure 5A:
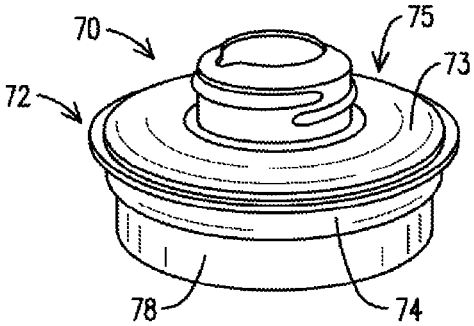
FIGS. 5A and 5B are perspective and cross-sectional side views, respectively, of the internal fitment of the composite container, in accordance with yet another representative embodiment.
Figure 5B:
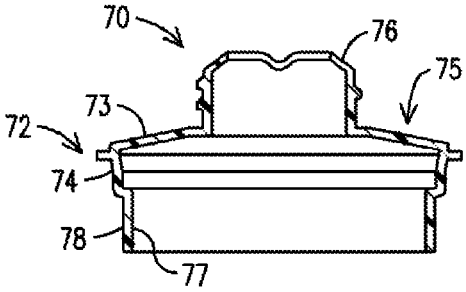

FIGS. 5A and 5B are perspective and cross-sectional side views, respectively, of yet another embodiment of the fitment 70 that can form the upper end of the composite container. In this configuration, the annular portion 73 of the fitment 70 between the aperture mount 78 and the perimeter edge 72 can be raised above the level of the outer rim to form a domed top surface 75. Both the attachment surface 74 and the sealing surface 78 can be formed into the stepped skirt 77 that extends downward from the underside of the annular portion 73, and with the aperture mount 78 extending proudly from the top side of the domed surface 75.

As shown in FIGS. 2B, 4B, and 5B, the elevation of the annular portion 23, 63, 73, respectively, between the aperture mount and the perimeter edge can vary between embodiments to provide a desired profile for the top surface of the upright container. The elevation can also be varied to provide a desired degree of stiffness for the attachment surface in maintaining its connection with the first end of the can, as well as a desired degree of flexibility for the sealing surface that can aid with the attachment of the products pouch to the fitment during the manufacturing process.

Figure 6A:
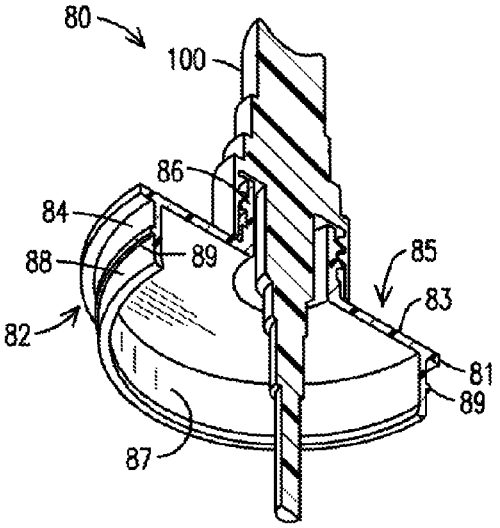
FIGS. 6A and 6B are perspective and cross-sectional side views, respectively, of the internal fitment and pump dispenser of the composite container, in accordance with yet another representative embodiment.
Figure 6B:
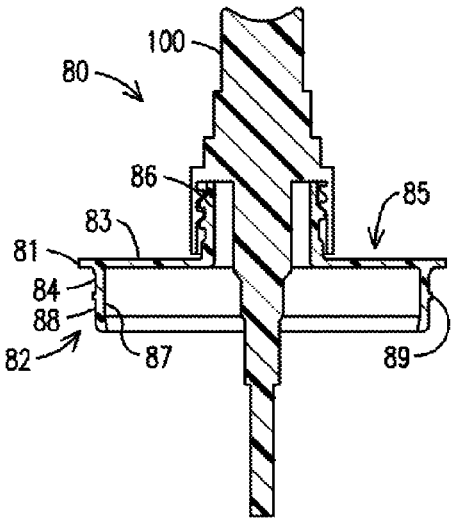

FIGS. 6A and 6B are perspective and cross-sectional side views, respectively, of yet another embodiment of the fitment 80 that can form the upper end of the composite container, and that also includes an attached pump spray dispenser-type closure 100. In this configuration, the annular portion 83 of the fitment 80 between the aperture mount 88 and the perimeter edge 82 can be aligned with the level of the outer rim to form a substantially-flat top surface 85. Both the attachment surface 84 and the sealing surface 88 can be formed into the skirt 87 that extends downward from the underside of the annular portion 83, rather than an inward step, with the skirt having a lower circumferential ridge 89 separating the attachment surface 84 from the sealing surface 86. Thus, the first end of the can may engage both the attachment surface 84 and the upper portion of the products pouch with a friction fit, and with the cut edge of the first end abutting the underside surface of an upper projecting ridge 81. The aperture mount 88 can extend proudly from the top surface 85 to receive the pump dispenser 100.

Figure 7A:
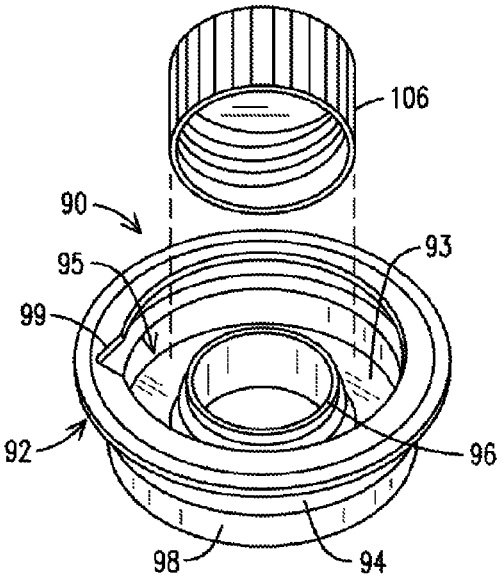
FIGS. 7A and 7B are perspective and cross-sectional side views, respectively, of the internal fitment and screw cap of the composite container, in accordance with yet another representative embodiment.
Figure 7B:
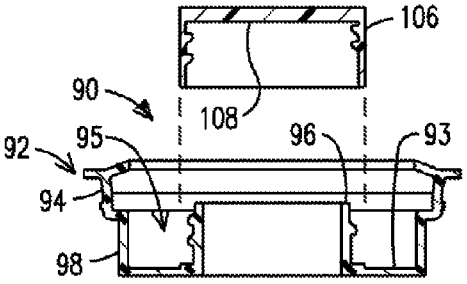

Illustrated in FIGS. 7A and 7B is yet another embodiment of the fitment 90 that can form the upper end of the composite container, in which the annular portion 93 of the fitment 90 between the aperture mount 96 and the perimeter edge 92 can be depressed to form the floor of a ring-shaped depression 95. As with the embodiment of the fitment shown in FIGS. 2A and 2B, both the attachment surface 94 and the sealing surface 98 can be formed into the outer sidewall surface of the downwardly-extending depression 95. However, in this aspect the center aperture that is defined by the aperture mount 96 can be provided with a wider opening to facilitate pouring of the product from the container, and a pour notch 99 can also be formed into the inside of the perimeter edge 92 for directing the flow of product away from the container.

Also shown in FIGS. 7A and 7B is a screw cap-type closure 106 that removably couples with the aperture mount 96 to close the aperture of the composite container, and that allows for the quick opening and re-closing of the container. In one aspect, the upper inside surface 108 of the screw cap 106 can be provided with a sealing surface that abuts against the top edge of the aperture mount 96 to provide an substantially airtight seal. In another aspect, the aperture can be sealed with a film or membrane that is adhesively coupled to the top edge of the aperture mount 96 prior to attaching the screw cap 106. If desired, snap cap closures (not shown) that allow for the quick opening and re-closing of the composite container may also be used.

Figure 8:
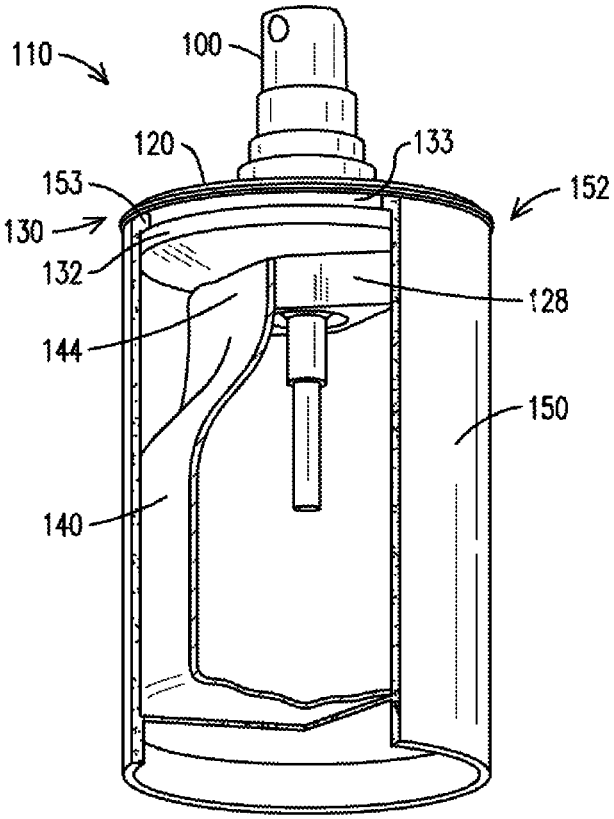
FIG. 8 is a cut-away perspective side view of the composite container having a pump dispenser, in accordance with yet another representative embodiment.
Figure 9:
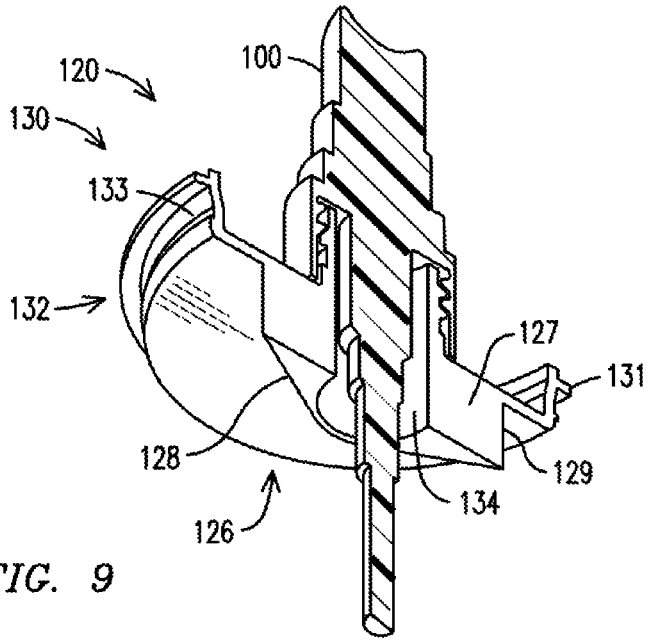
FIG. 9 is a perspective cross-sectional side view of the internal fitment and pump dispenser of the composite container of FIG. 8.

FIGS. 8 and 9 together illustrate another embodiment of the composite container 110 having a pump dispenser 100 for the closure. As discussed above, the perimeter edge 130 of the fitment 120 can include an attachment surface 132 having a groove 133 for receiving the bead 153 at the first end 152 of the can 150, along with the ridge or lip 131 extending radially outward from the perimeter edge 130 above the attachment surface 132 to form a rabbet fit that receives the first end 152 of the can 150 with the upper cut edge abutting the underside of the lip 131. In this embodiment, however, a non-circular protrusion 127 (FIG. 9) surrounding the aperture 134 can extend downward from the lower face 126 of the fitment 120, with the outside surfaces of the protrusion 127 forming two non-circular sealing surfaces 128.

In one aspect, the non-circular protrusion 127 can be a canoe-shaped body with pointed ends 129, with the side portions of the sealing surfaces 128 being well-spaced from the circular attachment surface 132 at the perimeter edge 130. Configuring the protrusion 127 with two sides, rather than as a circle, can be advantageous by allowing the upper portion 144 of the products pouch 140 to be clamped during the heat sealing process with a substantially uniform pressure across the extent of both sealing surfaces 128, while substantially reducing any inadvertent stretching, pinching or folding of the pouch material that might otherwise occur where two clamping jaws come together around a circular object.

In addition, the size of the opening in the upper portion 144 of the products pouch 140 can be less than the diameter of the fitment 120 at the perimeter edge 132 but greater than the perimeter of the non-circular protrusion 127. This can provide for the opening in the products pouch 140 to fit without stretching around the protrusion 127 while minimizing the amount of extra material that might result in folds or irregularities in the area of the hermetic seal. Indeed, the sealing surfaces 128 of the protrusion 127 can be shaped so that the upper portion 144 of the products pouch 140 is smoothly and uniformly folded over the sealing surfaces 128, with any extra pouch material being pressed together at the pointed ends 129 as the clamping jaws close together around the protrusion 127. This can reduce the likelihood of pinhole leakers in the hermetic seal between the pouch 140 and the sealing surfaces 128, and with the material of the products pouch 140 becoming sealed to itself proximate the pointed ends 129 to accommodate any dimensional variations in the pouch opening.

Figure 10:
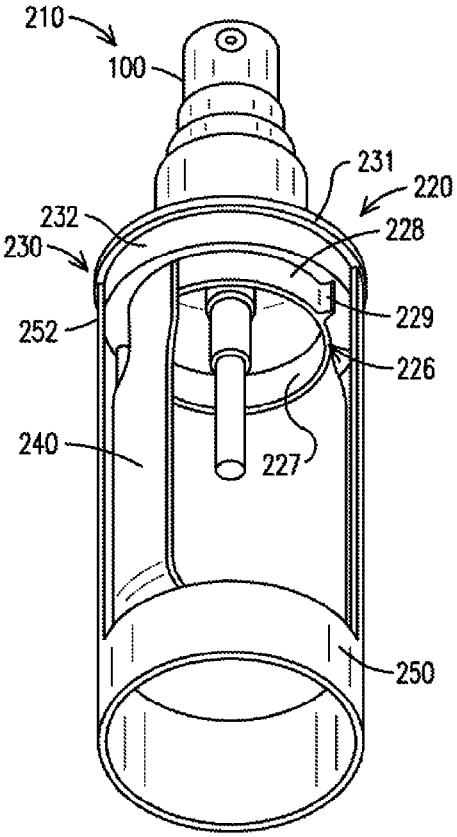
FIG. 10 is a cut-away perspective view of the composite container having a pump dispenser, in accordance with yet another representative embodiment.
Figure 11:
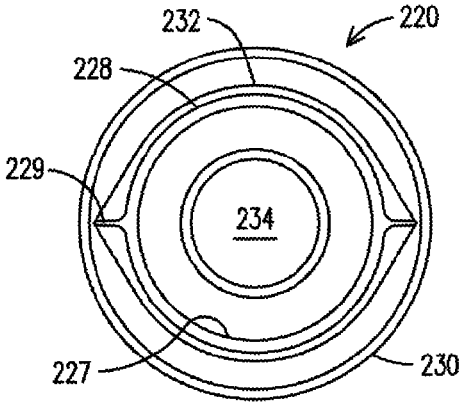
FIG. 11 is a bottom view of the internal fitment of FIG. 10.

FIGS. 10 and 11 together illustrate yet another embodiment of the composite container 210 also having a pump dispenser 100 for the closure. In this embodiment, a non-circular skirt 227 can extend downward from the layer face 226 of the fitment 220 to surround the aperture 234 and define the sealing surface 228. The skirt 227 can include opposing fins 229 that project outwardly to divide the sealing surface 228 into two sides, so that the products pouch 240 can be uniformly clamped by a pair of clamping jaws and heat sealed to the sealing surface 228 of the fitment 220, without folding or pinching the pouch material against the sealing surface 228. Thus, in some respects the opposing fins 229 can provide sealing benefits similar to those of the tapered canoe sealing surface shown in FIGS. 8-9, but with a larger aperture 234.

Also shown in FIG. 10, in one aspect the attachment surface 232 at the perimeter edge 230 can be formed as a smooth surface without a groove, and with the upper end 252 of the can 250 having a straight cut edge without a bead. In this configuration, the upper end 252 of the can 250 can be secured to the attachment surface 232 with a friction fit and/or with an adhesive (not shown but known to one of skill in the art), with the cut edge abutting the underside of the lip 231 to align the fitment 220 with the can.

Figure 12B:
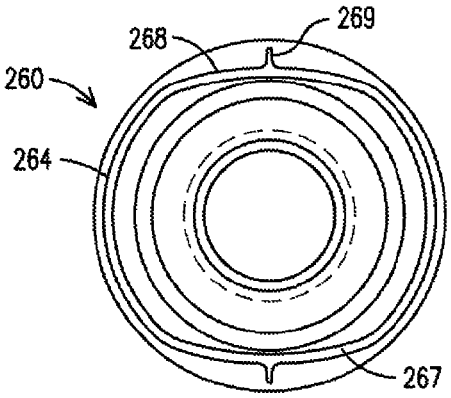
FIGS. 12A and 12B are perspective and bottom views, respectively, of the internal fitment of the composite container, in accordance with yet another representative embodiment.
Figure 12A:
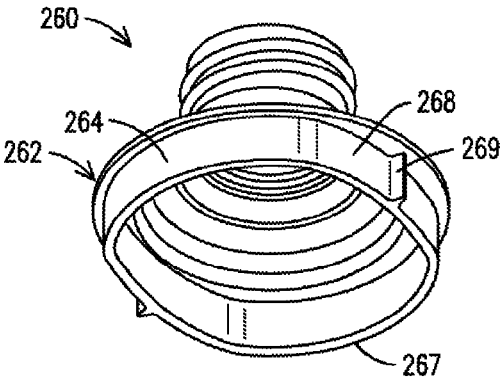

The fitment 260 of FIGS. 12A and 128 can also include a pair of opposing fins 269 that project outwardly from the downwardly-extending skirt 267 to divide the sealing surface 268 into two sides for substantially uniform clamping. However, the outermost rounded portions of the skirt 267 can extend closer to the perimeter edge 262 to also serve as the attachment region 264 for the upper end of the can (not shown). Thus, as may be appreciated by one of skill in the art, with the products pouch (also not shown) being sealed to the sealing surface 268 prior to the installation of the can, the upper portion of the products pouch may then become clamped between the inside surface of the can and the sealing surface 268 of the fitment around selected portions of the circumference of the sealing surface 268.

Figure 13A:
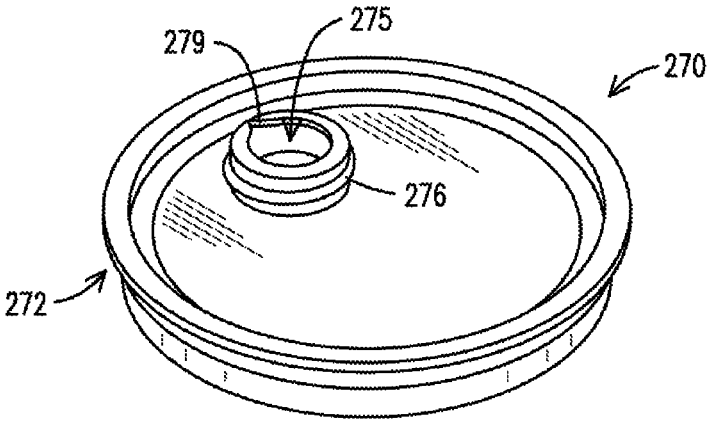
FIGS. 13A and 13B are perspective and cross-sectional side views, respectively, of the internal fitment of the composite container, in accordance with yet another representative embodiment.
Figure 13B:
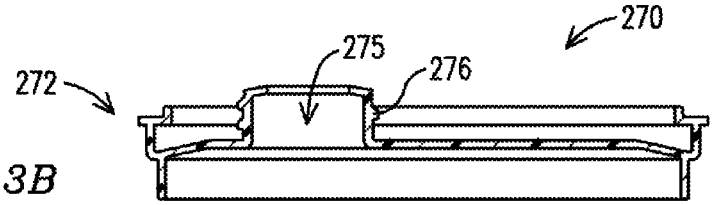

FIGS. 13A and 138 illustrate yet another aspect of the present disclosure in which the fitment 270 of the composite container has an aperture 275 and aperture mount 276 that are not centered around the axis of the fitment, but instead are moved closer toward the perimeter edge 272. This embodiment of the composite container can be especially suitable for liquids and pourable solids, and may also include a pour notch 279 formed into the upper edge of the aperture mount 276 that is closest to the perimeter edge 272 to facilitate accurate pouring of the product contained within the products pouch.

Figure 14:
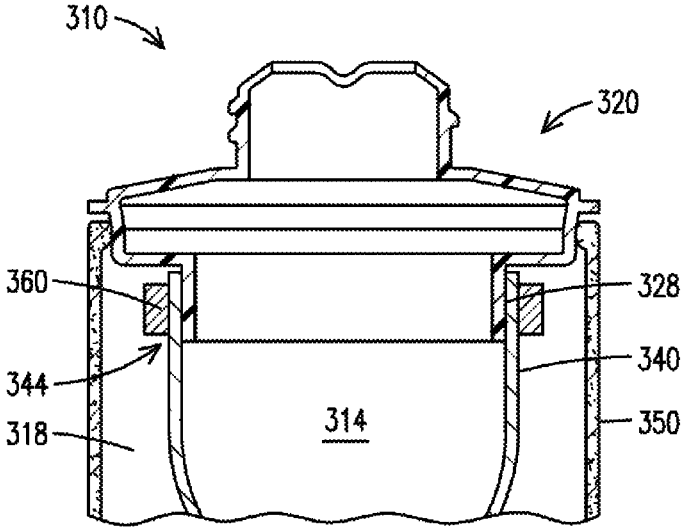
FIG. 14 is a cross-sectional side view of the internal fitment of the composite container, in accordance with yet another representative embodiment.

FIG. 14 illustrates yet another aspect of the present disclosure in which the composite container 310 further includes a reinforcing sealing ring 360 that mounts around the upper end 344 of the products pouch 340 that is sealed to the sealing surface 328, to further secure and maintain the hermetic seal between the products pouch 340 to the fitment 320 when the product contained within the air tight volume 314 becomes pressurized. For instance, the reinforcing sealing ring 360 can be useful in circumstances where the composite container 310 is moved to a higher altitude after being initially filled at a lower altitude, and wherein the products pouch 340 is likely to swell with the pressure differential between the air tight volume 314 and the annular interior volume 318 that can be in fluid communication with ambience. The reinforcing sealing ring 360 can also be useful for maintaining the hermetic seal when the contained product is pressurized during filling, such as with a carbonated beverage.

Figure 15A:
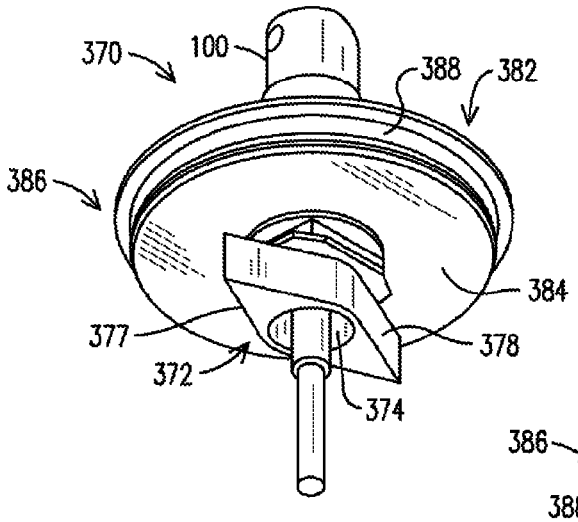
FIGS. 15A and 15B are perspective and cross-sectional side views, respectively, of an internal fitment and pump dispenser of the composite container, in accordance with yet another representative embodiment.
Figure 15B:
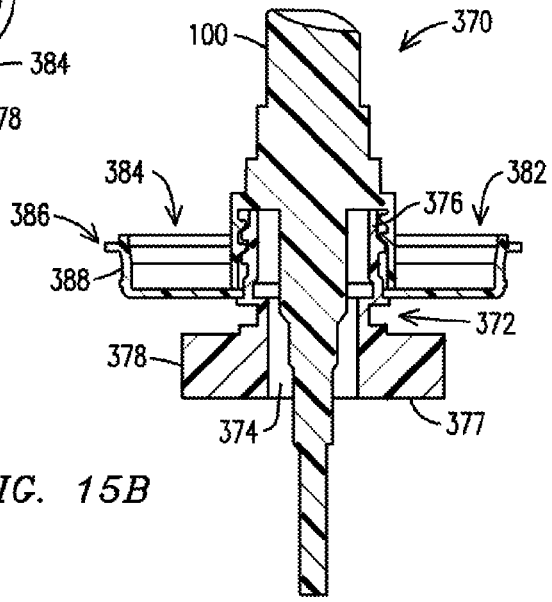

FIGS. 15A and 15B together illustrate yet another aspect of the present disclosure in which the fitment 370 (with pump dispenser 100) of the composite container can be provided with a multi-body construction, such as a center body 372 with an aperture 374 being coupled to an annular body 382. The center body 372 can generally include an aperture mount 376 surrounding and defining the upper portion of the aperture 374, as well as a lower sealing member 377 surrounding and defining the lower portion of the aperture 374 and having an outer sealing surface 378. In turn, the annular body 382 can generally include an annular portion 384 surrounded by a perimeter edge 386 with an attachment surface 388 formed therein. With the lower sealing member 377 extending radially below the bottom surface of the annular portion 384, the annular interior volume defined by the can (not shown) may extend between the bottom surface of the annular portion 384 and the sealing member 377, and partly over the top of the products pouch (also not shown).

Indeed, in one aspect the fitment 370 of FIGS. 15A and 15B may also be used to further define and separate the various functions of the composite container, with the center body 372, the products pouch and the closure (i.e. the dispenser 100) together defining the sealed containment function of the composite container, and with the annular body 382 and the can (including the optional base) together defining the structural support and puncture protection functions of the composite container. Moreover, because the can may be used to provide the outer structural support and puncture protection features, without the sealed containment features, the materials and processes used to form the can may be simplified considerably. In this way the costs associated with making the composite container may be reduced.

Figure 16:
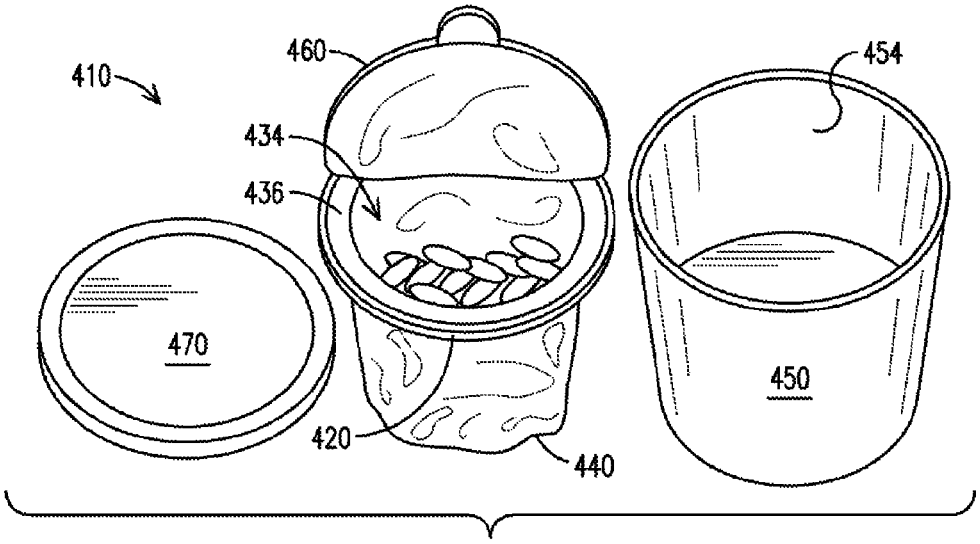
FIG. 16 is a perspective view of the disassembled composite container, in accordance with yet another representative embodiment.

Another embodiment of the composite container 410 is shown disassembled in FIG. 16. In the embodiment, the fitment 420 forming the end of the container can have a large, wide-mouth aperture 434 extending between the outer face and the inner face, and with a ring-shaped aperture mount 436 around its circumference. The aperture mount 436 generally includes a substantially planar surface that is configured to receive a peel-away membrane 460 which forms the initial closure that seals the aperture 434 with an airtight seal. A products pouch 440 is sealed to and suspended from the lower face of the fitment 420, with the body 454 of the can 450 surrounding and protecting the products pouch 440 from puncture.

The composite container 410 can further include an overcap 470 that covers and protects the peel-away membrane 460 prior to opening the composite container 410, and that allows for reclosing the aperture 434 once the peel-away member 460 has been removed to form a succeeding closure that substantially reduces the exchange of air between inner volume 414 of the composite container 410 and ambience. The composite container 410 with the large aperture 434, the peel-away membrane 460, and the overcap 470 can be especially useful for the packaging and storage of solid products such as coffee, powdered drink mixes, nuts, candies, snacks and other small perishable items.

Figure 17:
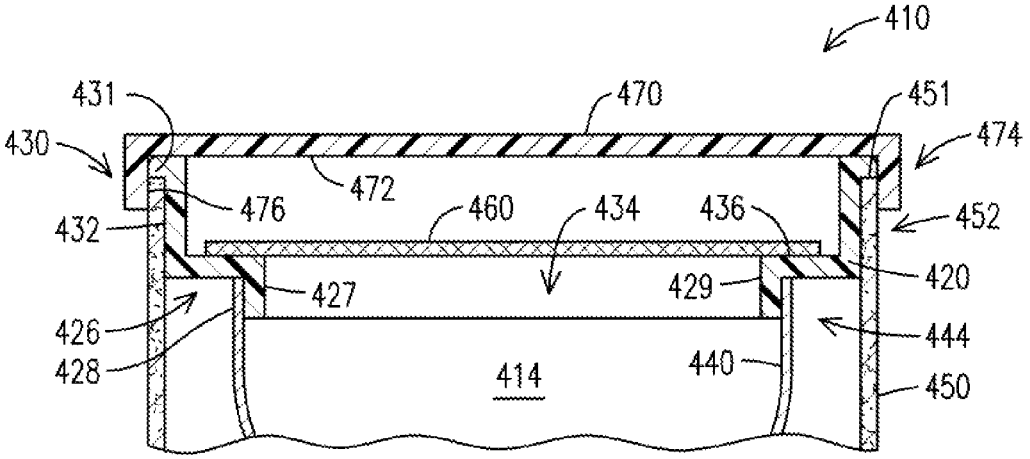
FIG. 17 is a cross-sectional side view of the upper portion of the composite container of FIG. 16.

Although the aperture 434 of the fitment 420 can be much larger in size than the apertures of the other embodiments of the composite container discussed above, the remaining features of the fitment 420 can be similar. For example, as shown in FIG. 17, the perimeter edge 430 of the fitment 420 of the composite container 410 generally includes an attachment surface 432 for coupling to the upper first end 452 of the can 450. In one aspect, the perimeter edge 430 can also include a boss or lip 431 extending radially outward from the perimeter edge 430 above the attachment surface 432, and that together with the attachment surface, forms a rabbet fit that receives the first end 452 of the can 450 with the cut edge 451 abutting the underside of the lip 431.

The fitment 420 can also include a skirt 427 that projects downward from the lower face 426, with the outside of the skirt forming the sealing surface 428 and the inside surface 429 of the skirt further defining the aperture 434. The pouch opening in the upper portion 444 of the products pouch 440 can be heat sealed around the sealing surface 428 with a hermetic seal to form an airtight inner volume 414 defined by the interior surface of the pouch 440, the inside surface 429 of the skirt 427, and the bottom of the peel-away membrane 460.

The overcap 470 can be made from a flexible material such as LDPE or polypropylene, and can couple with the fitment 420 in a variety of ways. For instance, as shown in FIG. 17, the outer rim 474 of the cap 470 can flex open to snap into position surrounding the first upper end 452 of the can 450 and the perimeter edge 430 of the fitment 420. In this embodiment, the bottom surface 472 of the overcap 470 can press down on the top surface of the lip 431while the inside surface 476 of the outer rim 474 presses inward on the upper end 452 of the can 450 to provide a seal that can substantially reduce the exchange of air between the inner volume 414 of the composite container 410 and ambience.

Figure 18:
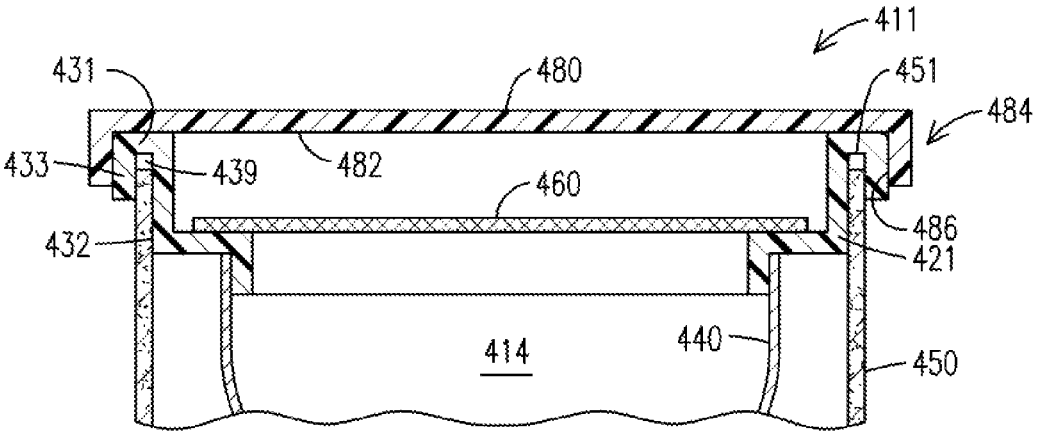
FIG. 18 is a cross-sectional side view of the upper portion of the composite container, in accordance with yet another representative embodiment.

In another embodiment of the composite container 411 shown in FIG. 18, the lip 431 of the fitment 421 may be extended to include an overhang 433 that, together with the attachment surface 432 and inside surface of the lip 431, forms a circular notch or slot 439 for receiving therein the cut edge 451 of the can 450. The circular slot 439 can be installed around the cut edge 451 to provide a secure connection between the fitment 421 and the can 450 with or without the use of an adhesive. In this configuration, moreover, the outer rim 484 of the cap 480 can be flexed open to snap into position contacting both the outer surface of the overhang 433 and top surface of the lip 431. As each of these surfaces of the fitment 421 can be provided with a surface finish that is more consistent and smooth than the surface finish of the can 450 (see FIG. 17), both the inside surface 486 of the outer rim 484 and the inside bottom surface 482 of the overcap 480 can provide a primary and secondary seal, respectively, that can substantially, if not entirely, reduce the exchange of air between inner volume 414 of the composite container and ambience.

Figure 19:
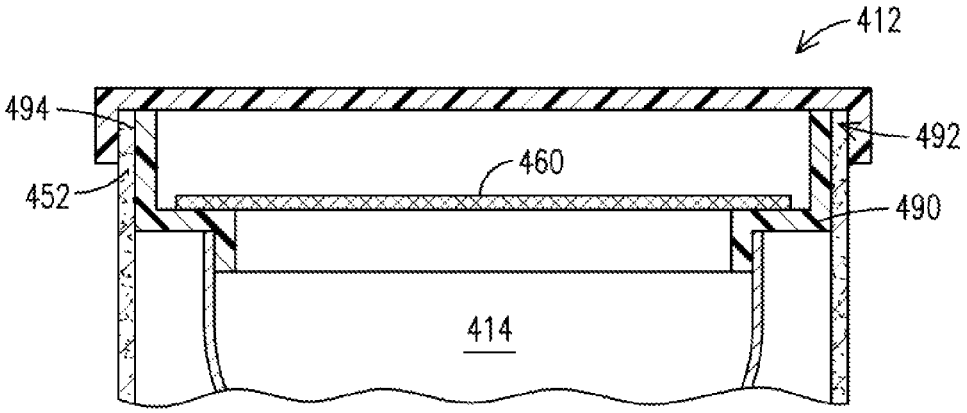
FIG. 19 is a cross-sectional side view of the upper portion of the composite container, in accordance with yet another representative embodiment.

In another aspect of the composite container 412 shown in FIG. 19, the perimeter edge 492 of the fitment 490 can have a substantially straight attachment surface 494 that is secured to the top end 452 of the can 450 with an adhesive. The attachment surface 494 can be substantially vertical or, in the alternative, can be angled slightly outward so that the fitment 490 becomes wedged into the top end 452 of the can 450 during insertion and prior to the setting of the adhesive.

Figure 20:
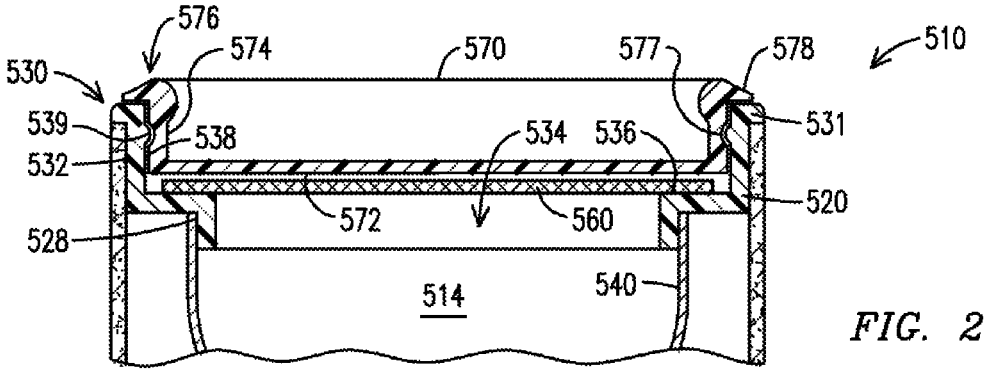
FIG. 20 is a cross-sectional side view of the upper portion of the composite container, in accordance with yet another representative embodiment.
Figure 21A:
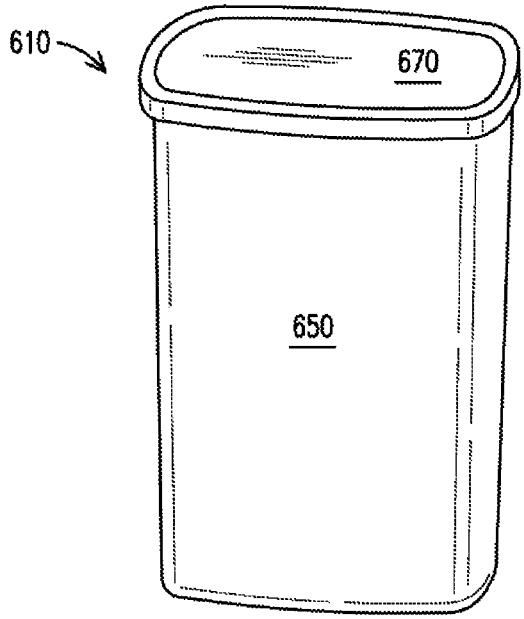
FIGS. 21A and 21B are left and right perspective side views, respectively, of the composite container, in accordance with yet another representative embodiment.
Figure 21B:
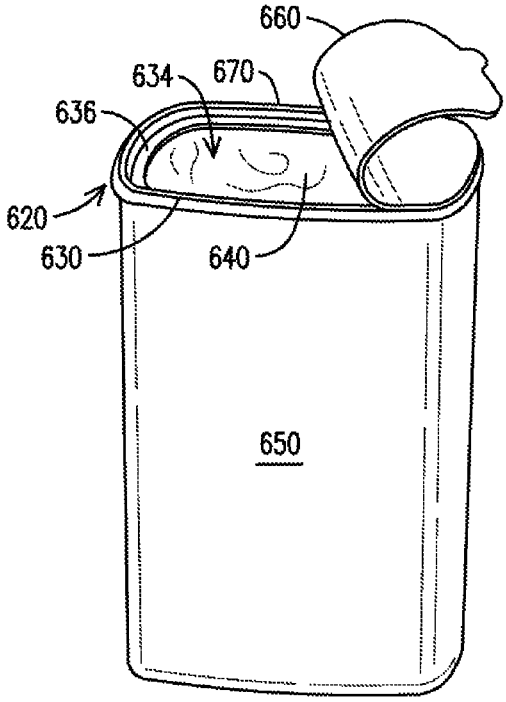

As shown in FIG. 20, in yet another aspect of the composite container 510 the fitment 520 can include a plug 570 to protect the peel-away membrane 560 prior to opening the composite container 510 and to reclose the aperture 534 once the peel-away member 560 has been removed. In this embodiment, the outer sidewalls 574 of the plug 570 can be inserted within the interior sidewalls of the perimeter edge 530 of the fitment 520 that are opposite the attachment surface 532. The interior sidewalls 538 of the fitment 520 can also include a ridge 539 that extends into a complimentary notch 577 formed into the outer sidewalls 574 of the plug 570, so that the plug snaps into a sealing position when installed over the aperture 534 in the fitment 520. Furthermore, the membrane 560 can also comprises a thin film so that after its removal, the bottom surface 572 of the plug 570 can contact the planar aperture mount surface 536 to provide a primary seal that substantially, if not entirely, reduces the exchange of air between inner volume 514 of the composite container and ambience. In another aspect, the top outer edge 576 of the plug may also include an outwardly-extending lip 578 that mates with the top surface of the lip 531 that extends outward from the perimeter edge 530 the fitment 520, to provide a secondary seal that compliments the primary seal and further isolates the inner volume 514 after removal of the sealing membrane 560.

Although the composite container has been shown above as generally having a upright, cylindrically-shaped body with the perimeter edge of the fitment being circularly-symmetric around a vertical longitudinal central axis, the container is not limited to this configuration. Indeed, it is contemplated that the composite container may be formed with a wide variety of other shapes and configurations, such as the rectangular shaped composite container 610 illustrated in FIGS. 21A and 218. As shown, the composite container 610 can have a rectangular configuration with the perimeter edge 630 of the fitment 620 being mirrored across a longitudinal vertical plane that passes through the center of the container 610. The composite container 610 can include a wide-mouth rectangular aperture 634 with a narrow aperture mount surface 636 around its circumference to which a peel-away membrane 660 can be been affixed to initially seal the aperture 634 with an airtight seal. With an internal products pouch 640 hermetically sealed to the sealing surface extending downwardly from the inner face of the fitment 620, and separate from the outer can 650 that provides the structural support and puncture protection for the composite container, the container 610 can provide an improved packaging system for scoopable solid products such as sugar, powders, dry mixes and the like. As with the wide-mouth embodiments described above, the composite container 610 can also include a overcap 670 that covers and protects the peel-away membrane 660 prior to opening the composite container 610, and that allows for reclosing the aperture 634 once the peel-away member 660 has been removed.

Figure 22:
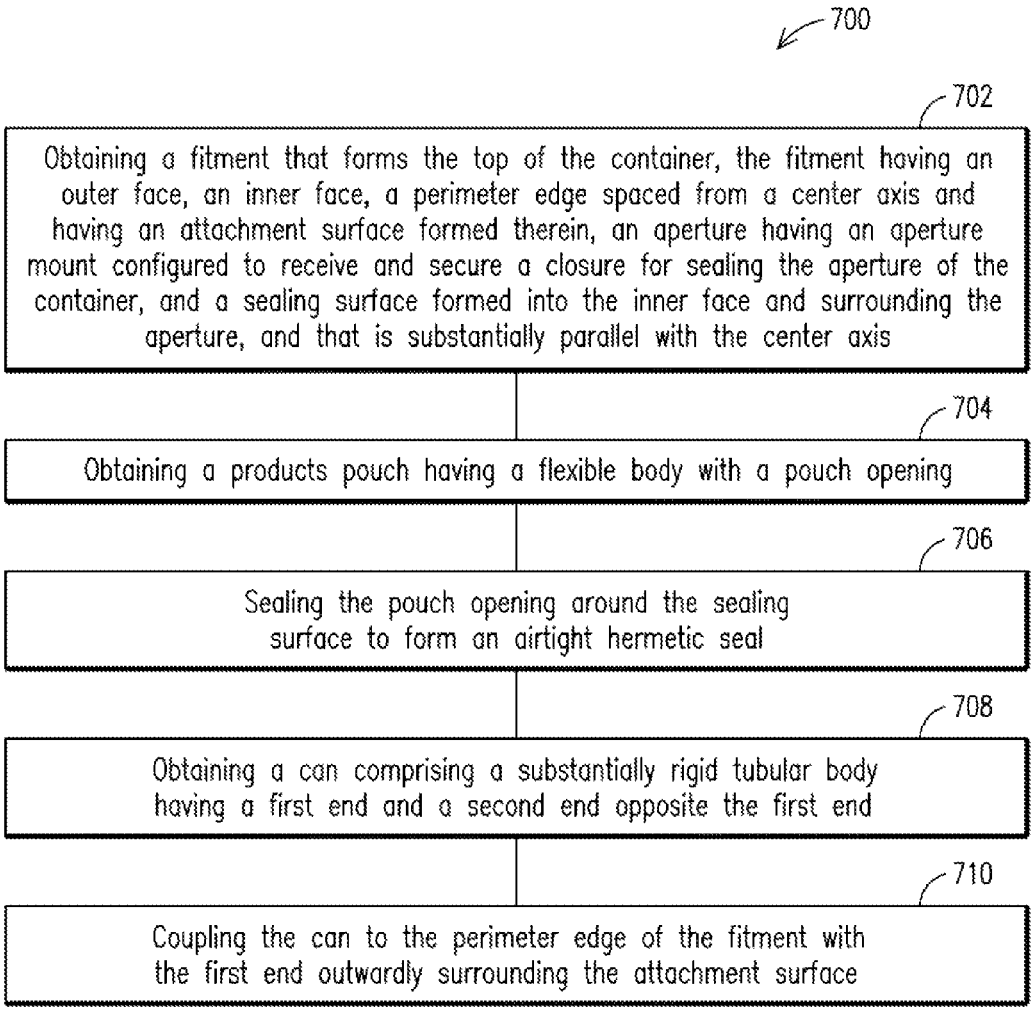
FIG. 22 is a flowchart depicting a method of making the composite container, in accordance with another representative embodiment.

FIG. 22 is a flowchart depicting one method 700 for making a composite container with enhanced separability for the segregation of recyclable waste after use. The method 700 includes obtaining 702 a fitment that forms the top of the container, the fitment having an outer face, an inner face, a perimeter edge spaced from a center axis and having an attachment surface formed therein, an aperture extending between the outer face and the inner face and having an aperture mount configured to receive and secure a closure for sealing the aperture of the container, and a sealing surface formed into the inner face and surrounding the aperture, and that is substantially parallel with the center axis. The method 700 also includes obtaining 704 a products pouch having a flexible body with a pouch opening, and sealing 706 the pouch opening around the sealing surface to form an airtight hermetic seal. The method 700 further includes obtaining 708 a can comprising a substantially rigid tubular body having a first end and a second end opposite the first end and coupling 710 the can to the perimeter edge of the fitment with the first end outwardly surrounding the attachment surface.

The invention has been described herein in terms of preferred embodiments and methodologies considered by the inventor to represent the best mode of carrying out the invention. It be understood by the skilled artisan, however, that a wide range of additions, deletions, and modifications, both subtle and gross, may be made to the illustrated and exemplary embodiments without departing from the spirit and scope of the invention. These and other revisions might be made by those of skill in the art without departing from the spirit and scope of the invention that is constrained only by the following claims.

What is claimed is:

1. A composite container for storing product in a sealed hermetically sealable volume, the container comprising:

a can having a spirally wound substantially-rigid cylindrically shaped can sidewall defining an interior volume, a top end defining an opening and a bottom end on which the can may rest during use, the top end comprising a bead;

a substantially cup-shaped fitment comprising a substantially disc-shaped portion covering the opening and defining an aperture and having an inner face, an outer face and a perimeter, a skirt extending upwardly from the perimeter of the covering portion and having an attachment surface formed therein, the attachment surface defining a groove for receiving the bead at the top end of the can, an aperture mount extending upwardly from the covering portion and having a central bore that communicates with the aperture, and a protrusion extending downwardly from the inner face and surrounding the aperture, the protrusion having a sealing surface facing away from the aperture;

a products pouch disposed within the interior volume and having an airtight body with a pouch opening, the products pouch being heat sealed directly to the sealing surface with a hermetic seal to form a hermetically sealable inner volume; and a closure mountable to the aperture mount and configured to seal the aperture, the closure having a dispensing end located outside the hermetically sealable volume and an intake end located inside the hermetically sealable volume.

2. The container of claim 1, wherein the composite container includes a longitudinal axis and the sealing surface is substantially parallel with the longitudinal axis.

3. The container of claim 1, wherein the first end of the can outwardly surrounds the attachment surface of the fitment.

4. The container of claim 1, wherein the pouch opening is further secured to the sealing surface with a clamp ring.

5. The container of claim 1, wherein the sealing surface forms a non-circular cylinder.

6. The container of claim 1, wherein a material forming the fitment is selected from the group consisting of a high-density polyethylene (HDPE), a polypropylene (PP), nylon 6 and a acrylonitrile-methyl acrylate copolymer.

7. The container of claim 1, wherein a material forming the products pouch is selected from the group consisting of a polypropylene film, a acrylonitrile-methyl acrylate copolymer film, a laminate comprising a polyethylene terephthalate (PET) film adhered to a linear low-density polyethylene (LLDPE) film, a laminate comprising a metalized PET film adhered to a high-density polyethylene (HDPE) film, a laminate comprising a PET film adhered to a metallic foil adhered to a LLDPE film, and a laminate comprising a PET film adhered to a metallic foil adhered to a nylon 6 extrudate.

8. The container of claim 1, wherein the products pouch includes at least one gusset.

9. The container of claim 1, wherein the can is made from paperboard.

10. The container of claim 1, further comprising a base coupled to the bottom end of the can and enclosing the interior volume.

11. The container of claim 10, wherein the base further comprises a plug base that is insertable into the bottom end of the can and having a rabbet fit.

12. The container of claim 10, wherein a material of the base is selected from the group consisting of a paperboard material and a metallic material.

13. The container of claim 1, wherein the aperture mount is a threaded neck finish extending outwardly from the outer face.

14. The container of claim 1, wherein the closure is a pump spray dispenser.

15. The container of claim 1, wherein the aperture mount is a circumferential surface substantially perpendicular to the center axis.

16. The container of claim 1, wherein the products pouch is scored proximate the sealing surface to facilitate the separation of the products pouch from the fitment after use.

17. A composite container for storing product in a sealed hermetically sealable volume, the container comprising:

a can having a rigid, cylindrically shaped can sidewall defining an interior volume, a top end defining an opening and a bottom end on which the can may rest during use, the top end comprising a straight cut top edge;

a substantially cup-shaped fitment comprising a substantially disc-shaped portion covering the opening and defining an aperture and having an inner face, an outer face and a perimeter, a skirt extending upwardly from the perimeter of the covering portion and having an attachment surface formed therein, the attachment surface being attached to the straight cut top edge by a friction fit, an aperture mount extending upwardly from the covering portion and having a central bore that communicates with the aperture, and a protrusion extending downwardly from the inner face and surrounding the aperture, the protrusion having a sealing surface facing away from the aperture;

a products pouch disposed within the interior volume and having an airtight body with a pouch opening, the products pouch being heat sealed directly to the sealing surface with a hermetic seal to form a hermetically sealable inner volume; and a closure mountable to the aperture mount and configured to seal the aperture, the closure having a dispensing end located outside the hermetically sealable volume and an intake end located inside the hermetically sealable volume.

18. The composite container of claim 17, wherein the container defines a longitudinal axis and the sealing surface is substantially parallel with the longitudinal axis.

19. The container of claim 18, wherein the sealing surface forms a non-circular cylinder.

20. A composite container for storing product in a sealed hermetically sealable volume, the container comprising:

a can having a rigid, cylindrically shaped can sidewall defining an interior volume, a top end defining an opening and a bottom end on which the can may rest during use, the top end comprising a straight cut top edge;

a substantially cup-shaped fitment comprising a substantially disc-shaped portion covering the opening and defining an aperture and having an inner face, an outer face and a perimeter, a skirt extending upwardly from the perimeter of the covering portion and having an attachment surface formed therein, the attachment surface being attached to the straight cut top edge by adhesive, an aperture mount extending upwardly from the covering portion and having a central bore that communicates with the aperture, and a protrusion extending downwardly from the inner face and surrounding the aperture, the protrusion having a sealing surface facing away from the aperture;

a products pouch disposed within the interior volume and having an airtight body with a pouch opening, the products pouch being heat sealed directly to the sealing surface with a hermetic seal to form a hermetically sealable inner volume; and a closure mountable to the aperture mount and configured to seal the aperture, the closure having a dispensing end located outside the hermetically sealable volume and an intake end located inside the hermetically sealable volume.

* * * * *